US005902057A

United States Patent [19]

Furrow et al.

[11] Patent Number: 5,902,057

[45] Date of Patent: May 11, 1999

[54] PRINT RIBBON CARTRIDGE WITH RE-INKER ASSEMBLY

[75] Inventors: Edward D. Furrow; Paul W. Snyder, both of Waynesboro, Va.

[73] Assignee: Genicom Corporation, Waynesboro, Va.

[21] Appl. No.: 08/926,012

[22] Filed: Sep. 9, 1997

[51] Int. Cl.[6] ..... B41J 32/00

[52] U.S. Cl. ..... 400/196.1; 400/196

[58] Field of Search ..... 400/196.1, 196, 400/194, 207, 208

[56] References Cited

U.S. PATENT DOCUMENTS

| | | | |
|---|---|---|---|
| 4,526,488 | 7/1985 | Krull | 400/202.4 |
| 4,988,224 | 1/1991 | Furrow et al. | 400/194 |
| 5,007,750 | 4/1991 | Goubeaux | 400/196.1 |
| 5,051,010 | 9/1991 | Stephens et al. | 400/196.1 |
| 5,531,528 | 7/1996 | Duerr et al. | 400/200 |

FOREIGN PATENT DOCUMENTS

| | | | |
|---|---|---|---|
| 000488784 | 6/1992 | European Pat. Off. | 400/208 |
| 0049474 | 3/1985 | Japan | 400/196.1 |

*Primary Examiner*—Edgar Burr
*Assistant Examiner*—Anthony H. Nguyen
*Attorney, Agent, or Firm*—Nixon & Vanderhye

[57] ABSTRACT

The ribbon cartridge includes a re-inker assembly having a pair of idler rollers defining a nip therebetween through which the print ribbon is advanced. The idler rollers have teeth intermeshing one with the other and with the print ribbon therebetween such that the idler rollers are positively driven when the ribbon is advanced. One of the idler rollers lies in contact with a re-inker roller or wick for transferring ink from the re-inker roller or wick to the print ribbon as the ribbon passes through the nip of the idler rollers.

8 Claims, 4 Drawing Sheets

PRINT RIBBON CARTRIDGE WITH RE-INKER ASSEMBLY

TECHNICAL FIELD

The present invention relates to ribbon cartridges containing a print ribbon for use in printers and particularly relates to a ribbon cartridge re-inker assembly for re-inking the print ribbon as the print ribbon is advanced through the cartridge.

BACKGROUND OF THE INVENTION

In commercial high speed printers, ribbon cartridges are typically consumable items discarded after use and replaced with fresh cartridges. To extend the life of the print ribbon within the cartridge, various systems have been employed. For example, re-inking systems for applying fresh ink to the print ribbon have been utilized. While various types of re-inker systems are known, such systems conventionally advance the print ribbon against a re-inker roller or an idler roller having a smooth surface in contact with the re-inker roller. Thus, the drive mechanism for advancing the ribbon from a ribbon exit arm of the cartridge across the span in opposition to the print head and for entry into the entrance arm of the cartridge must also advance the ribbon past the idler roller in contact with the re-inker roller or with the re-inker roller per se. In the typical system employing a re-inker roller, substantial tension on the ribbon is required such that the ribbon can frictionally bear against and drive the idler roller which in turn must also drive the re-inker roller or directly engage and drive the re-inker roller. This assures that a fresh supply of ink is readily available for transfer to the ribbon and also ensures that the ink transfer actually occurs. A substantial portion of the ribbon must therefore wrap about the idler roller or re-inker roller in order to rotate the roller and ensure ink transfer to the ribbon. This higher tension required on the ribbon in order to rotate the re-inker roller is undesirable because such increased tension on the print ribbon causes problems in the drive mechanism. Additionally, it will be appreciated that the print ribbon as it leaves the storage chamber within the cartridge is drawn about various corners which increase the frictional drag on the print ribbon, exacerbating the already undesirable increased tension on the ribbon caused by the need to rotate the re-inker roller. In certain systems, the re-inker assembly also fails because of slippage between the print ribbon and the idler roller resulting in failure of the ink to transfer to the print ribbon.

SUMMARY OF THE INVENTION

In order to cure the foregoing and other disadvantages of prior re-inker systems, the present invention provides a re-inker assembly wherein the advance of the print ribbon positively drives the re-inking roller or ensures positive contact with an applicator for supplying fresh ink to the print ribbon as it advances past the re-inker assembly. Particularly, a pair of idler rollers are provided and define a nip through which the print ribbon passes as it is advanced from the storage chamber toward the ribbon exit arm of the cartridge. The idler rollers are disposed relative to one another such that the print ribbon passing through the nip is gripped by the ribbon. Stated differently, the ribbon is clamped between the rollers such that when the ribbon is pulled through the rollers, the rollers are forced to rotate and this rotating motion of the rollers is used to rotate a mating re-inker roller or afford positive engagement with a re-inking applicator. The rotary motion of one of the rollers, of course, transfers ink from the re-inker roller or applicator through the one idler roller to the print ribbon.

In a preferred form of the present invention, the rollers are provided with gear teeth which intermesh with one another. With the ribbon passing between the rollers and along the intermeshing teeth, the advance of the print ribbon positively drives the idler rollers. That is, the idler rollers are locked against slippage relative to one another and to the print ribbon. Further, where the re-inker roller is formed of an open cell foam material, the gear teeth on the one idler roller between the re-inker roller and the print ribbon may resiliently and flexibly engage the re-inker roller to ensure that the re-inker roller rotates in response to the advancing movement of the print ribbon through the nip of the idler rollers to provide a continuous supply of fresh ink to the ribbon.

It will be appreciated that the rate of ink transfer can be adjusted. For example, by displacing the idler rollers toward or away from the foam material of the re-inker roller or an applicator wick, the pressure between the one idler roller and the re-inker roller or wick can be adjusted and hence, the rate the ink transfer likewise is adjustable.

In a preferred embodiment according to the present invention, there is provided a ribbon cartridge for a printer comprising a print ribbon, a cartridge housing defining a storage chamber for receiving and storing the print ribbon and including a pair of arms projecting to one side of the housing adjacent opposite ends of the housing, the arms defining ribbon entrance and exit paths, respectively, for receiving the ribbon for delivery to the storage chamber and supplying the ribbon from the storage chamber for spanning between the arm in opposition to a printhead carried by the printer, a drive mechanism carried by the housing for advancing the print ribbon from the exit arm across the span between the arms and into the print ribbon entrance arm and a ribbon re-inker carried by the housing for delivering ink to the print ribbon including a re-inker applicator having a supply of ink and a pair of idler rollers defining a nip therebetween, the ribbon passing through the nip and engaging the rollers to drive the rollers in response to advance of the print ribbon by the drive mechanism, one of the rollers lying in contact with the re-inker applicator for transferring ink from the applicator to the one idler roller and onto the ribbon as the ribbon is advanced through the nip.

In a further preferred embodiment according to the present invention, there is provided a re-inker assembly for re-inking a print ribbon of a ribbon cartridge comprising a re-inker applicator containing a supply of ink, a pair of idler rollers defining a nip therebetween for receiving the print ribbon and rotatable in response to advance of the print ribbon through the nip of the rollers, one of the rollers lying in engagement with the applicator for transferring ink from the applicator to the one roller for transfer to the ribbon as the ribbon is advanced through the nip.

In a still further preferred embodiment of the present invention, there is provided a method of re-inking a print ribbon comprising the steps of rotating a pair of idler rollers by advancing the print ribbon through a nip between the idler rollers with the ribbon engaging the rollers whereby the advance of the print ribbon rotates the rollers and contacting one of the idler rollers with an applicator containing ink whereby rotation of the one roller in contact with the applicator transfers ink from the applicator onto the one idler roller and in contact with the ribbon transfers ink from the one idler roller to the ribbon.

Accordingly, it is a primary object of the present invention to provide a novel and improved re-inker assembly for a print ribbon cartridge for a printer and methods of operating the cartridge wherein the print ribbon is continuously re-inked with minimal tension.

DISCLOSURE OF THE INVENTION

Figure 1:
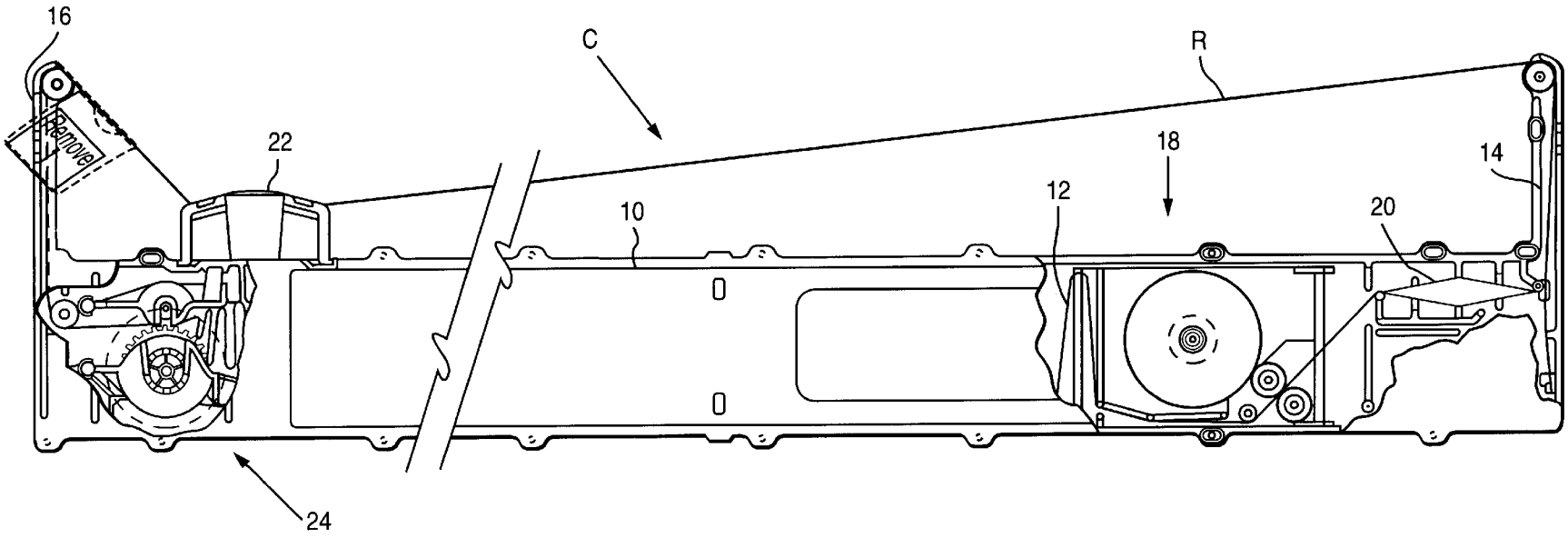
FIG. 1 is a plan view of a ribbon cartridge for a printer with parts broken out for ease of illustration.

Referring now to FIG. 1, there is illustrated a cartridge C for mounting in a printer, not shown, adjacent a print deck wherein the ribbon R of the cartridge passes between the substrate, i.e., paper, on which printing is desired and a print head, not shown. Particularly, cartridge C includes a housing 10 having a ribbon storage chamber 12 disposed between a ribbon exit arm 14 and a ribbon entrance arm 16. As is conventional, the ribbon R is stored in the storage chamber 12 in a random manner. The ribbon passes from the chamber 12 through a re-inker assembly constructed in accordance with the present invention and generally designated 18. Ribbon from re-inker assembly 18 then passes through a mobius 20 en route to the exit arm 14. A ribbon guide 22 locates the ribbon R in registration with the print head, it being appreciated that the print head traverses back and forth along the length of the substrate, not shown, under control of the printer to effect printing on the substrate. The ribbon R may be endless, e.g., seamed or welded, or can be of a discrete length.

A ribbon drive mechanism generally designated 24 is disposed within the housing 10 for advancing the ribbon along the span between the exit and entrance arms 14 and 16, respectively. That is, the drive mechanism 24 functions to draw the ribbon R from the exit arm 14 across the span between the arms and into the entrance arm 16 for storage within the chamber 12. It will be appreciated that as the ribbon R is drawn from the exit arm 14, the ribbon passes through the re-inker assembly 18 and the mobius 20. Drive mechanisms for advancing ribbon through a cartridge are well known and further description thereof is not believed necessary. Suffice to say that the drive mechanism has one or more drive rollers forming a nip which receives and advances the ribbon under control of the printer. Typically, the ribbon is advanced during a printing mode when the print head moves in a direction opposite the direction of the advancement of the ribbon, the ribbon, however, remaining stationary during movement of the print head in the same direction as the advance of the ribbon. The drive mechanism includes connections not shown which interconnect with mating drive mechanisms on the printer whereby the drive mechanism 24 is under the control of the printer.

Figure 2:
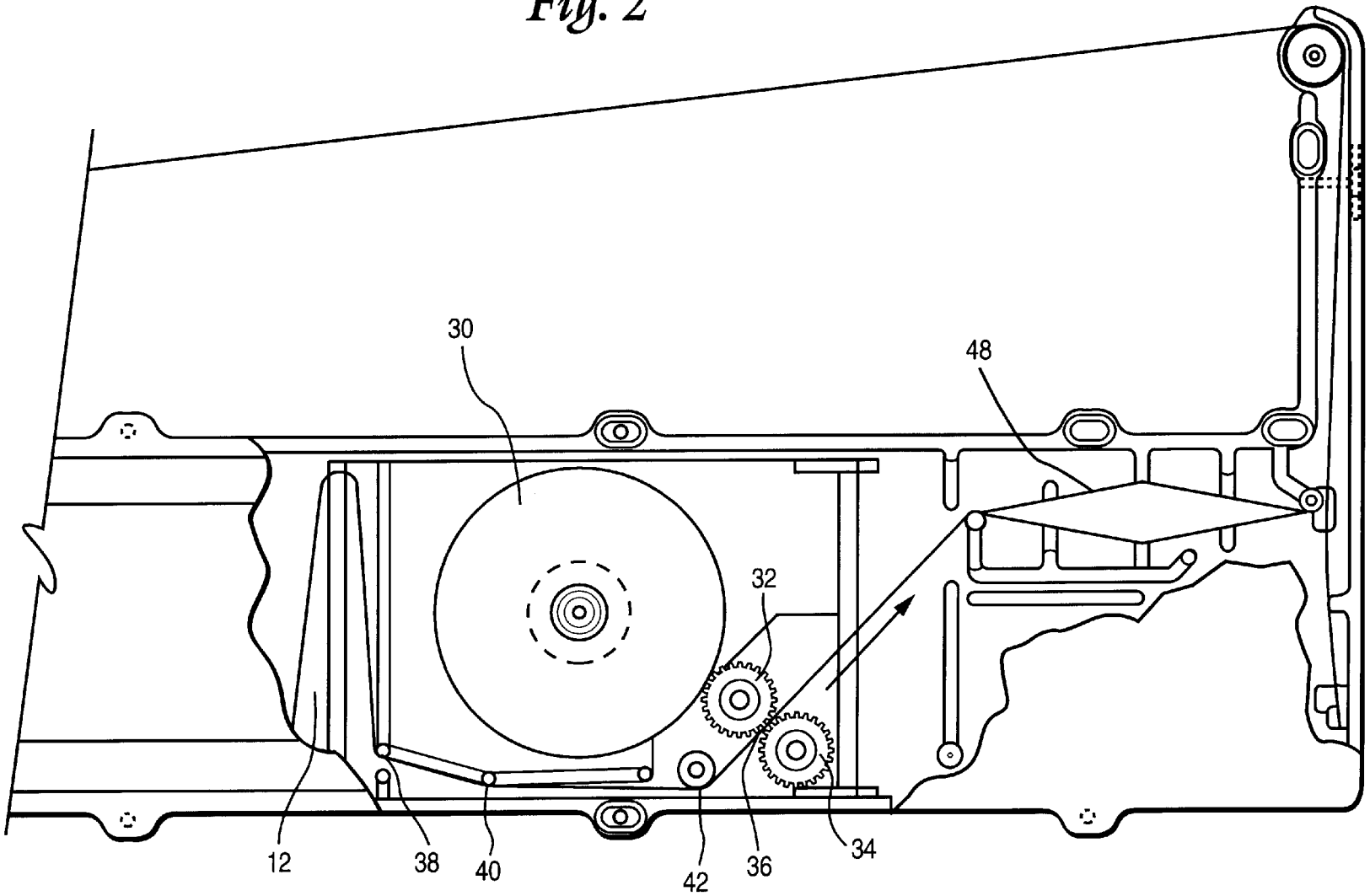
FIG. 2 is an enlarged fragmentary view of the ribbon exit end of the cartridge illustrating a re-inker assembly according to the present invention.

Adjacent the opposite end of the cartridge from the drive mechanism 24, a re-inker assembly 18 is located within the housing 10. Referring to FIG. 2, the re-inker assembly includes a re-inker roller 30 mounted for rotation between upper and lower walls of the cartridge C. The re-inker roller is preferably formed of an open cell foam material such as a foamed, felted urethane saturated with ink. Alternatively, as illustrated, a wick can be stationarily mounted in the housing to supply ink from the re-inker wick to the print ribbon in the manner described.

Figure 3:
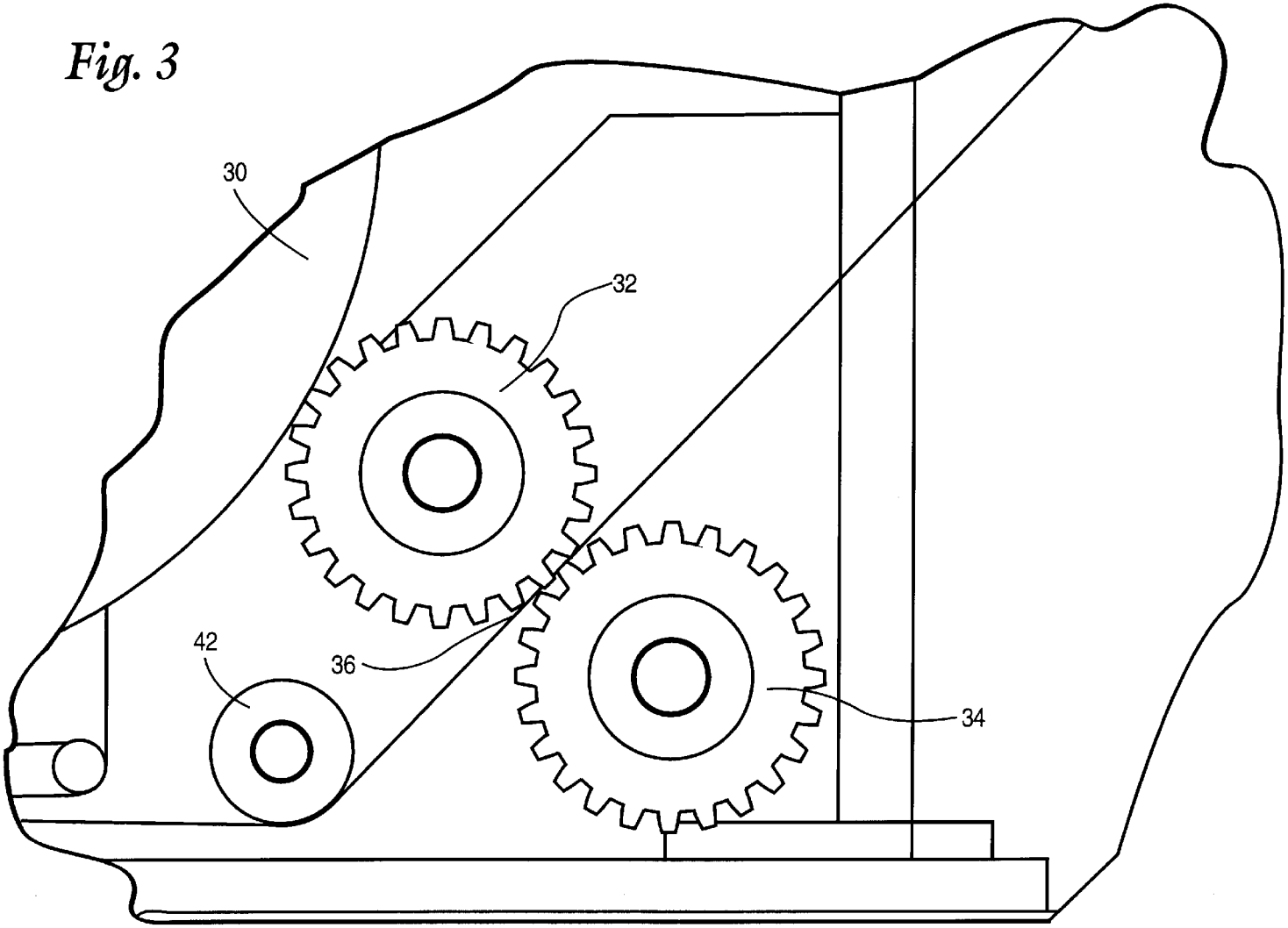
FIG. 3 is an enlarged fragmentary view of the idler rollers with the print ribbon passing through the nip of the idler rollers.
Figure 4:
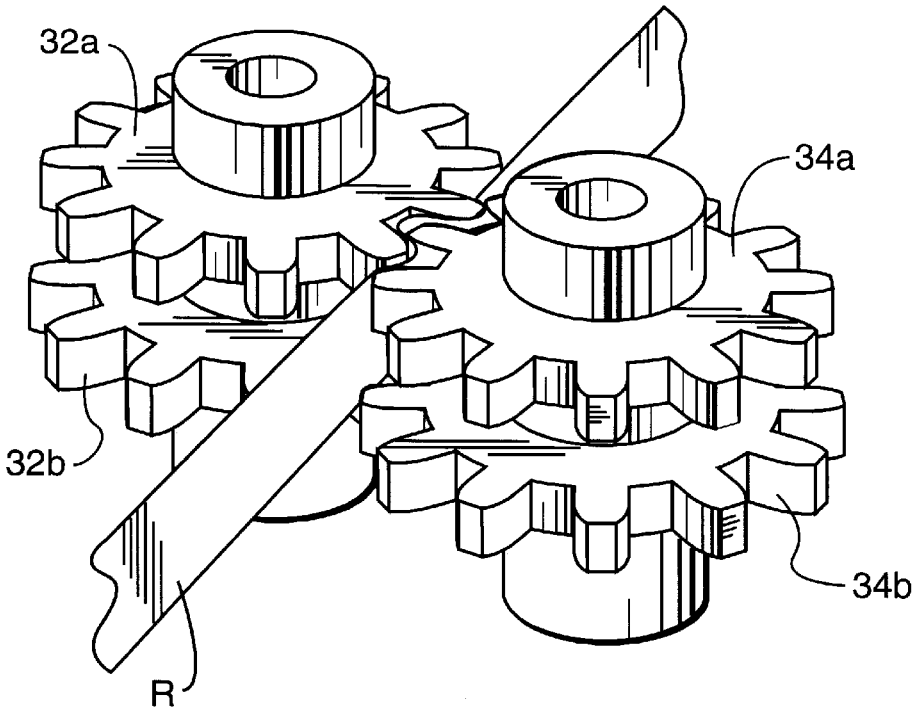
FIG. 4 is a perspective view of the idler rollers with the ribbon passing therebetween.

The re-inker assembly 18 also includes a pair of idler rollers 32 and 34 defining a nip 36 therebetween through which the print ribbon R is advanced. Thus, as illustrated in FIG. 2, the print ribbon R is advanced by the drive mechanism 24 from the storage chamber 12 about posts 38 and 40 and about a rotatable pin 42 adjacent nip 36. As illustrated in FIG. 2, the print ribbon does not contact directly the re-inker roller 30 or a wick. Rather, ink is supplied to the print ribbon by the idler roller 32 which lies in contact with the print ribbon and with the re-inker roller 30. While the surfaces of the idler rollers 32 and 34 can be smooth, there is a possibility of slippage of the print ribbon relative to one or both of the idler rollers and consequently slippage of the one idler roller and the re-inker roller in the absence of sufficient tension on the ribbon to prevent slippage. Accordingly, in accordance with the present invention, the idler rollers of the re-inker assembly are preferably formed with intermeshing gear teeth about their outer surfaces. Thus, as best illustrated in FIGS. 3 and 4, the gear teeth intermesh and interlock with one another at the nip 36. As a consequence, rotation of one idler roller requires rotation of the opposite idler roller due to the positive drive between the rollers afforded by the intermeshing teeth. Additionally, it will be appreciated that the ribbon R passes between the gear teeth of the respective idler rollers 32 and 34. While a tight fit is not necessary, the print ribbon will assume a very similar configuration as the intermeshing teeth of the idler rollers as the ribbon passes through the nip of the rollers. Not only does the intermeshing of the ribbon with the teeth of the idler rollers provide a positive drive to the idler rollers from the ribbon drive mechanism but the ribbon engages along the faces of the teeth as it passes through the nip. Thus, the ribbon is in contact with the ink on the faces of the one roller 32 which thus transfers ink from the re-inker roller to the ribbon.

As illustrated in FIG. 4, the idler rollers each may comprise upper and lower rollers 32*a*, 34*a* and 34*b*, 34*b*, respectively. It will be appreciated that upper and lower portions of the ribbon R extend along a print line, the ribbon being inverted by a mobius loop 48 FIG. 2) to enable both upper and lower ribbon portions to lie in respective printing positions along the print line. Hence, each upper and lower portion of the ribbon is supplied with fresh ink from the re-inker roller via the upper and lower idler rolls 32*a*, 32*b*.

In order to meter the ink onto the ribbon, the pressure of the idler roller 32 against the re-inker roller 30 can be adjusted. With the surface of the re-inker roller being resilient and flexible, it will be appreciated that the teeth of the idler roller 32 can be set to a depth of penetration in the re-inker roller to ensure rotation of the re-inker roller in response to advance of the print ribbon through the nip of the idler rollers as well as to ensure adequate ink transfer to the idler roller and to the ribbon.

Figure 5:
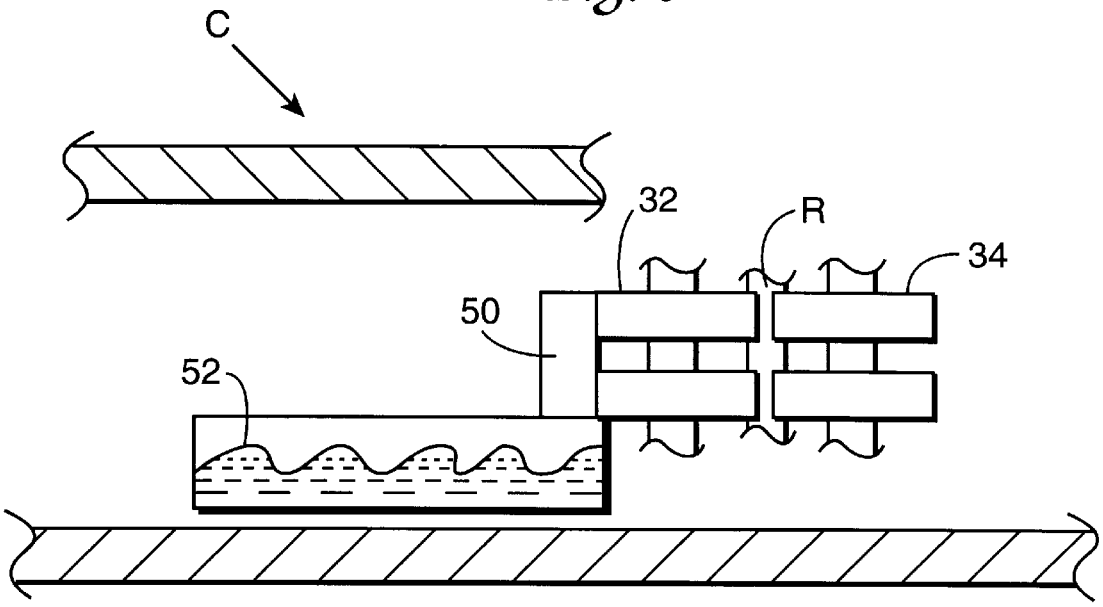
FIG. 5 is a schematic representation of one of the idler rollers bearing against a wick.

Instead of a re-inker roller, a wick 50 may be used to apply fresh ink to the idler roller 32 and to the ribbon engaged in the nip of rollers 32 and 34 as illustrated in FIG. 5. The wick may project from a reservoir or supply 52 of ink in liquid or gel form formed in the cartridge. For example, a container 52 for liquid ink may be provided with the wick 50 projecting upwardly therefrom for supplying ink to the idler roller 32 engaging wick 50.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A ribbon cartridge for a printer comprising:

a print ribbon;

a cartridge housing defining a storage chamber for receiving and storing said print ribbon and including a pair of arms projecting to one side of said housing adjacent opposite ends of said housing, said arms defining ribbon entrance and exit paths, respectively, for receiving said ribbon for delivery to the storage chamber and supplying said ribbon from the storage chamber for spanning between said arms in opposition to a printhead carried by the printer;

a drive mechanism carried by one end of said housing for advancing said print ribbon from the exit arm across the span between the arms and into the print ribbon entrance arm; and a ribbon re-inker carried by an opposite end of said housing for delivering ink to said print ribbon including a re-inker applicator having a supply of ink and a pair of idler rollers defining a nip therebetween, said ribbon passing through said nip and engaging said rollers to drive the rollers in response to advance of said print ribbon by said drive mechanism, one of said rollers lying in contact with said re-inker applicator for transferring ink from said applicator to said one idler roller and onto said ribbon as said ribbon is advanced through said nip;

at least said one roller having a plurality of teeth thereabout for engaging said ribbon at said nip and engaging said applicator.

2. A cartridge according to claim 1 wherein each said idler roller has a plurality of teeth thereabout interlocking with one another and with the ribbon therebetween.

3. A cartridge according to claim 2 wherein said applicator includes a flexible resilient surface, one of said idler rollers engaging and flexing said applicator surface to pick up ink from said applicator between said teeth for transfer to said ribbon.

4. A cartridge according to claim 3 wherein said applicator comprises a roller in engagement with said one idler roller wherein said one idler roller rotates said re-inker roller in response to advance of said print ribbon by said drive mechanism.

5. A cartridge according to claim 3 wherein said applicator comprises a roller.

6. A cartridge according to claim 3 wherein said applicator comprises a wick.

7. A method of re-inking a print ribbon comprising the steps of:

rotating a pair of idler rollers by advancing the print ribbon through a nip between said idler rollers with said ribbon engaging said rollers whereby the advance of the print ribbon rotates the rollers; and contacting one of said idler rollers with an applicator containing ink whereby rotation of said one roller in contact with said applicator transfers ink from the applicator onto said one idler roller and in contact with the ribbon transfers ink from said one idler roller to the ribbon; and interlocking said idler rollers with one another for joint rotation without slippage therebetween by meshing teeth on said pair of idler rollers.

8. A method according to claim 7 wherein said applicator includes a re-inker roller in contact with said one roller, and rotating said re-inker roller by contact with said one idler roller.

* * * * *